US009603438B2

(12) United States Patent
Lundqvist et al.

(10) Patent No.: US 9,603,438 B2
(45) Date of Patent: Mar. 28, 2017

(54) PAINTBALL POD HOLDER

(71) Applicants: Alex Mats Lundqvist, Astoria, NY (US); Max Lundqvist, Astoria, NY (US)

(72) Inventors: Alex Mats Lundqvist, Astoria, NY (US); Max Lundqvist, Astoria, NY (US)

(73) Assignee: Bunkerking Sports LLC, Astoria, NY (US)

( * ) Notice: Subject to any disclaimer, the term of this patent is extended or adjusted under 35 U.S.C. 154(b) by 153 days.

(21) Appl. No.: 14/723,189

(22) Filed: May 27, 2015

(65) Prior Publication Data

US 2015/0359319 A1 Dec. 17, 2015

Related U.S. Application Data

(60) Provisional application No. 62/012,538, filed on Jun. 16, 2014.

(51) Int. Cl.

| | |
|---|---|
| ***A45F 3/00*** | (2006.01) |
| ***A45F 5/00*** | (2006.01) |
| ***F42B 39/02*** | (2006.01) |
| *A45F 3/14* | (2006.01) |
| *A63B 47/00* | (2006.01) |

(52) U.S. Cl.

CPC ..... *A45F 3/005* (2013.01); *A45F 5/00* (2013.01); *F42B 39/02* (2013.01); *A45F 2003/144* (2013.01); *A63B 47/001* (2013.01)

(58) Field of Classification Search

CPC ..... A45F 3/005; A45F 2003/144; Y10S 224/919; Y10S 224/931; A45B 2200/0566; F42B 39/02; F42B 39/26

USPC ..... 294/250, 149, 150, 157; 248/693

See application file for complete search history.

(56) References Cited

U.S. PATENT DOCUMENTS

| | | | | |
|---|---|---|---|---|
| 6,158,642 | A | 12/2000 | Herbage | |
| D483,561 | S | 12/2003 | Charpentier | |
| 6,962,278 | B2 | 11/2005 | Obatake | |
| 7,100,810 | B1 * | 9/2006 | Bosch | F42B 39/02 224/196 |
| 7,520,412 | B2 * | 4/2009 | Willows | A45F 3/14 224/148.4 |
| 7,559,445 | B1 | 7/2009 | Kulp | |
| 2005/0121485 | A1 | 6/2005 | Spicer | |
| 2008/0185413 | A1 * | 8/2008 | Marques | A45F 5/02 224/674 |
| 2009/0114694 | A1 | 5/2009 | Lemanski et al. | |

* cited by examiner

*Primary Examiner* — Adam Waggenspack

(74) *Attorney, Agent, or Firm* — Johnson Legal PLLC

(57) ABSTRACT

The present invention provides a strapless holder that securely supports a generally cylindrical object, such as a paintball pod, within the retention tunnel by an elastic band that is curved to form at least a portion of a saddle-shaped, hyperbolic, paraboloid within the retention tunnel. Also provided is a method for using a retention strap-free holder for paintball pods for fast access to replenishment paintball pods.

13 Claims, 5 Drawing Sheets

PAINTBALL POD HOLDER

CROSS-REFERENCE TO RELATED APPLICATION

This application claims priority from U.S. Provisional Patent Application Ser. No. 62/012,538, filed on Jun. 16, 2014, the disclosure of which is incorporated herein by reference in its entirety.

FIELD OF THE INVENTION

The present invention relates to a vertically worn, retention strap-free, rear, pod pack for carrying one or more, typically multiple, tubes of paintballs (called "pods") for use during paintball games or practices.

BACKGROUND OF THE INVENTION

The majority of the paintball pod packs on the market today are worn around the player's waist and secured with one or more elasticized straps that are adjustable secured with hook-and-loop closure systems. On the rear of the pack and adjacent the player's back are a series of one or more, typically 3-10, slots or tunnels where pods are carried and stored during a game. Pods are generally carried with the pod's lid oriented in a downward direction and removed by pulling the pod down and out from the pack. Vertical pull (e.g., U.S. Pat. No. 6,158,642) and horizontal pull (e.g., U.S. Pat. No. 7,559,445 and US 2005/0121485) have also been disclosed.

The pod slots in a vertical pull harness come in one of two types, generally. The first is a semi-rigid tunnel that allows the pods to be removed and replaced with one hand. The second type of slot is an elastic band that is secured to the underlying waistband of the pack between or adjacent the semi-rigid tunnel slots. Once a pod is removed from these elastic bands, they are not readily replaced during play. The user would drop the empty pod and collect the empty pods once the game had concluded.

The vertical pull pod packs on the market today all use some type of hook-and-loop retention strap system to hold the individual pods in the semi-rigid slot of the pack. The hook portion of the fastener is on a lower retention strap, potentially an elasticized strap. This retention strap is attached to the waistband behind the pods and wraps downwardly, across the tube slot opening and upwardly to engage a loop fabric portion on the front of the pod slot. The retention strap thus secures the paintball pod within the slot of the pack. Typically, the upper end of the slot has an elasticized top strap or cover of some type that can be urged upwardly by stretching the retention strap across the opening of the pod tunnel and into a secured position on the outside of the tunnel with a corresponding loop portion of a hook-and-loop fastening system. The elastic of the upper end provides a downward force to provide a downward assist force when the retention strap is removed so the player can withdraw the pod downwardly and out from the tunnel. Examples of such paintball harnesses are shown in U.S. Pat. Nos. 6,962,278 and 7,100,810.

Unfortunately, the disengaged retention straps hang loosely down when not in use, and the hook-bearing portion of the strap often becomes engaged with adjacent loop portions of the pod slots, the pack assembly or even the player's shirt thereby impeding clear access to the pods and slots. To align the straps again correctly requires the use of two hands or assistance from another person.

In a strap-based pack system, sound connections between the retention strap and the pod tunnel are important. If not executed correctly, pods can slip from an unsecured slot and spill out on the ground thereby contaminating the paintballs with loose dirt and debris. Such contaminated paintballs cannot be reused without fouling the marker and represent a costly loss to the player.

Strap-based packs that rely on hook-and-loop closure systems are also prone to wear as the hook and loop portions become frayed, warn or fouled with debris over time. Such wear affects the ability of the strap to remain securely closed.

Strap-based systems also use valuable time to operate. As in most team sports, reloading time is critical in paintball games. Delays associated with pod removal and discharge into the loader reservoir can waste valuable seconds or even minutes that could lose the game for the affected player.

Given that current devices are difficult to use, require assistance or complete removal of the harness for paintball loading, and have a propensity for Velcro misalignment that reduces pod holding force, it is clear there is a need for an improved paintball pod holder.

It would be desirable to have a vertical pull pod pack harness that could hold a paintball pod securely in its slot of the pack during even extreme physical movement.

It would also be desirable to have a vertical pull paintball pod holder that could be loaded and unloaded easily and quickly using one hand.

Finally, it would be desirable to have a paintball pod holder that could withstand repeated use and still maintain its holding force on the pod within its slot in the carrying pack.

SUMMARY OF THE INVENTION

It is an objective of the invention to provide a paintball pod holder that will securely retain pods during even physical activity without the use of retention straps that must be pulled open to release the pod from its slot in the pack.

It is also an objective of the invention to provide a paintball pod holder that allows unimpeded one-handed removal of pods and reinsertion of empty pods.

It is also an objective of the invention to provide a paintball pod holder that will retain its holding force on the pod despite repeated use.

In accordance with these and other objectives that will become apparent from the description herein, a holder for generally cylindrical or round objects according to the invention includes at least one retention tunnel mounted on a waistband, wherein said retention tunnel comprises: (a) an elastic band having four sides and stretchable in a stretch plane, (b) a semi-rigid stabilizing plate that is relatively wider than said elastic band in said stretch plane, wherein said stabilizing plate is attached to said elastic band on either side of said band transverse to said stretch axis whereby said tension from said elastic band causes said stabilizing plate to bend and form a retention tunnel exhibiting elastic, radial, compression forces on a paintball pod inserted into said tunnel.

The invention also contemplates a method making the holder for use in a carrying harness that is especially well suited for paintball pods. This method comprises:

(a) sewing an elastic band having a stretch plane to a first end of semi-rigid stabilizing plate having a length to a second end that is greater than said elastic band along the stretch axis, the sewing occurring on one side of the elastic band in a direction transverse to the stretch plane;

(b) stretching said elastic band along said stretch axis to the second end of said stabilizing plate;

(c) sewing the stretched end of said elastic band to the second end of the stabilizing plate in a direction transverse to said stretching plane, wherein tension from said elastic band would urge said stabilizing plate to bend and form an arc if not restrained;

(d) sewing said elastic band along at least one edge thereof to said stabilizing plate in a direction that is substantially parallel to said stretch plane, whereby elastic tension from said elastic waistband urges said stabilizer plate to bend, and said elastic band bends to form at least a portion of a saddle-shaped, hyperbolic paraboloid within an arc of the bent stabilizing plate thereby forming a paintball pod retention tunnel subject to the transverse holding effects of at least a portion of the saddle-shaped, hyperbolic paraboloid elastic band; and (e) securing the first and second ends of said stabilizing plate to a back plate that is attached to elastic waistband straps.

The paintball pod holder of the present invention provides a new way of retaining paintball pods within the retention tunnel or slot of a paintball harness but without the use of retention straps over the removal end of the tunnel. Users save valuable time because filled pods can be removed from the retention tunnel slot easily with one hand and also reinserted without the delays associated with conventional retention straps. The invention also does not suffer from the entangling effects of disengaged, hook-and-loop, retention straps or the risk of spill from a retention strap that is not properly secured to its mating connection.

DETAILED DESCRIPTION OF THE INVENTION

Figure 1:
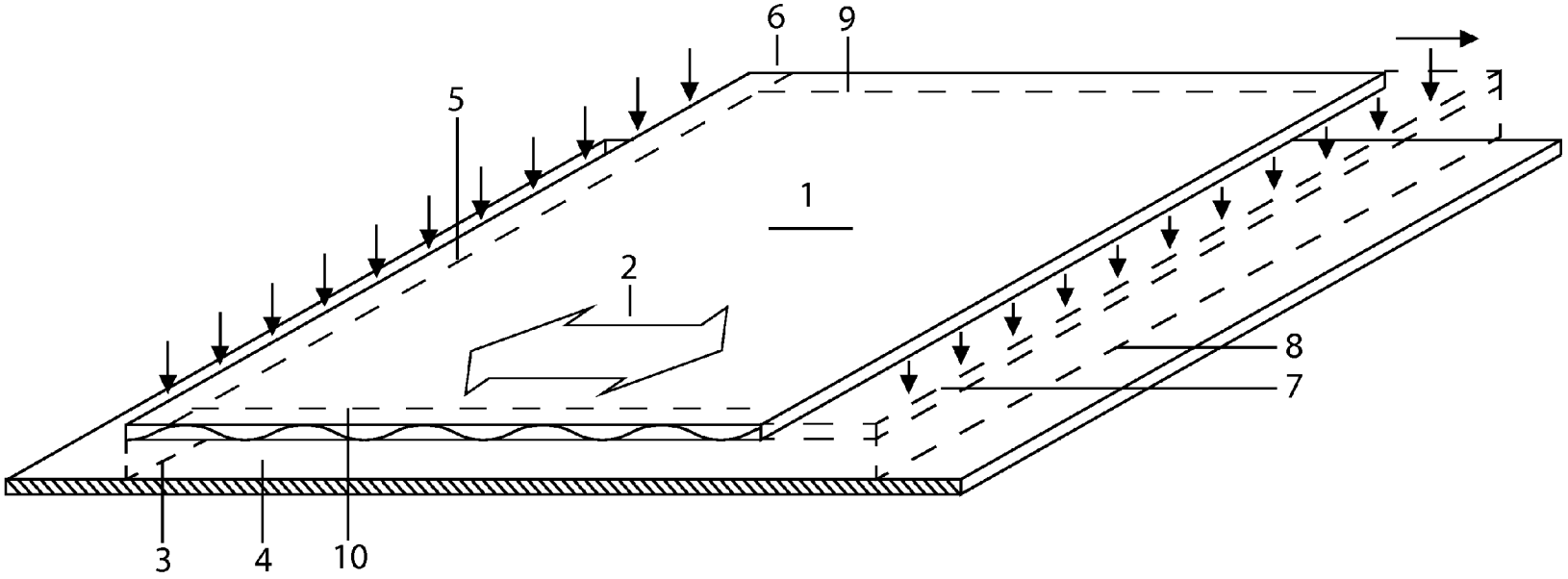
FIG. 1 illustrates how an elastic band is first sewn to a semi-rigid stabilizing plate on one side, stretched, and then secured at its stretched end to the stabilizing plate.

The present invention provides a holder with a novel structure for retaining generally cylindrical objects, preferably paintball pods, within a retention tunnel or slot on a carrying harness. In particular, the retention tunnel is formed by a semi-rigid stabilizer plate that is secured by at least two of its edges to a smaller piece of elastic band. When that band is stretched and secured to the stabilizing plate, the plate is urged into a bent shape that forms an interior tunnel of elastic that becomes curved to form a saddle-shaped, hyperbolic, paraboloid that extends inwardly into the formed tunnel. The contours of this curved elastic within the retention tunnel provide a convenient and effective transverse elastic pressure that pushes against a pod inserted into the tunnel and holds it there until removed.

This retention tunnel may then be attached to a back plate with its own waistband and/or mounted on an inner waistband that is overwrapped with the outer waistband for additional security. Hook-and-loop fasteners are compatible with the durable synthetic fabric that are conventionally used for paintball harnesses and are preferably used liberally to provide multiple points of support about the user's waist.

Preferably, the elastic band exhibits elasticity along a single, planar direction and is shorter in length along that stretch plane than the semi-rigid stabilizing plate.

The stabilizing plate is the outer shell of each retention tunnel and should be sufficiently rigid to be self-supporting but should also allow bends without changing length or width dimensions. The stabilizing plate is also preferably made of a weather resistant fabric material that can be sewn together with the elastic band and, optionally, a back plate that carries the other retention tubes and any auxiliary elastic loops for added carrying capacity.

The back plate is also desirably semi-rigid and should have sufficiently structural integrity and durability to hold one or more, preferably 3-6, retention tunnels (made of the stabilizing plate and stressed elastic band) in place. This back plate also creates the floor of each retention tunnel and should permit some degree of bending to permit a generally cylindrical tube to be inserted into each retention tunnel.

In making the retention tunnel according to the invention, the stabilizing plate and elastic band are positioned and sewed along one end that is transverse to the stretch plane of the elastic. The elastic is extended along its stretch plane and then sewed along this second end. If released, the elastic will contract and bend the stabilizing plate into an arc.

In the preferred retention tunnel, the elastic band and stabilizing plate are sewn together along at least two, preferably at least three, and even more preferably along all four ends of the elastic band—two seams transverse to the stretch plane along each side of the tunnel and two seams substantially parallel to the stretch plane at the front and rear openings of the tunnel. The stressed elastic band assumes a generally saddle-shaped, hyperbolic paraboloid shape in which elastic under tension extends into the retention tunnel to provide the holding force on pods loaded therein. It will be understood that the elimination of a sewn seam may form a retention web having the shape of a partial hyperbolic paraboloid.

Using the present invention, users are able to load generally cylindrical round objects or sports balls. Such objects include paintball pods, water bottles, sporting equipment, working tools, or other gear into the holding tunnel using only one hand. The holding tunnel will prevent the inserted item from falling out without utilizing holding straps that extend over the insertion opening and which would have to be removed before making an unobstructed opening for removal of the retained item. When removing the paintball pod, or other item requiring secure storage, the user simply pulls it out of the holding tunnel with one hand without the need to release any holding straps first.

The present invention can be used in various areas of sport such as, for example, a water bottle and equipment holder. It could also be used in hunting or for military to secure and carry equipment, e.g., flashlights, flares, lights and other such generally cylindrical objects without using any holding straps. The one-handed ease with which items can be inserted and removed saves time in critical situations. The present invention can hold bottles or containers of water and equipment for athletes such as long-distance runners, skiers, and climbers. It can also serve as a ball holder for sporting games such as golf and tennis. Among other applications, the invention can be used by hunters or military personnel to provide secure storage with easy, quick access. It is convenient to describe the retention tunnels and associated harness with reference to their use in holding generally cylindrical paintball pod tubes having a closed end and an open end that is releasably closed with a frictional or locking lid.

The retention tunnels can be attached to a wide variety of paintball pod carrying harnesses for use in a number of orientations, e.g., top pull, side pull and vertical downward pull. Plain elastic loops can also be attached to the tunnel support harness to provide additional pod carrying capacity, with the recognition that empty pods are not readily replaced into such elastic loops. Preferably, the retention tunnels of the invention are oriented on the harness for a downward pull removal.

Preferably, the carry pack has two or more pod retention tunnels that are oriented vertically for a downward pull to release the retained pods. This means that loading the pods involves inserting each pod vertically and upwardly through the bottom opening and into the pod retention tunnel. As noted above, each retention tunnel is secured to the carry pack and indirectly via hook-and-loop system to an elastic waistband that is adjustably secured via another hook-and-loop connection. The retention tubes are dimensioned so that radial, transverse, frictional force from the interior wall of the retention tunnel wall on the outer wall of the inserted pod retains the pod within said carry pack. This allows the carry pack to avoid the use or need for restraining straps that would otherwise be needed in a conventional carry pack to cover the bottom openings of each retention tunnel and retain the inserted pod therein.

The attached figures are conveniently used to describe preferred, exemplary, embodiments of the invention. Similar structures will use the same reference numbers in the various figures.

Referring now to FIG. 1, an elastic band 1 having a stretch plane 2 is sewn near first end 3 of semi-rigid stabilizing plate 4 to secure elastic band 1 and stabilizing plate 4 together.

Stabilizing plate 4 preferably exhibits a length along stretch plane 4 that is longer than the resting, unstretched length of elastic band 1. Stitches 5 that secure the first end 6 of the elastic band to the first end 3 of stabilizing plate 4 preferably extend the length of elastic band 1 in a direction that is transverse to stretch plane 2. This allows elastic band 1 to be stretched along stretch plane 2 and be secured, preferably with sewing stitches, along second end 7 of elastic band 1 and near second end 8 of stabilizing plate 4.

Figure 2:
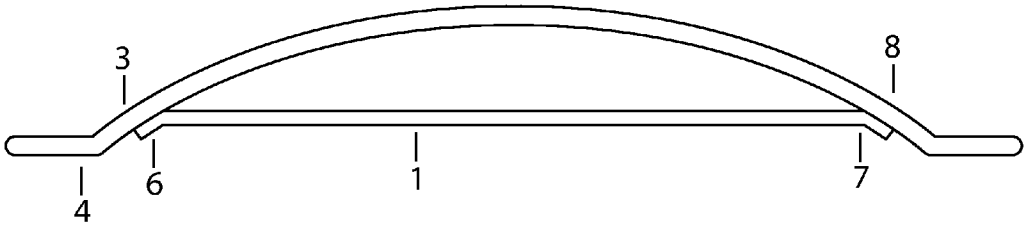
FIG. 2 shows a view of the elastic band that has been secured at opposing ends along its stretch plane to the semi-rigid stabilizing plate that has been urged into a curved bend.

As shown in FIG. 2, if stabilizing plate 4 was released, the elastic tension would urge plate 4 into a bent or arcuate shape. Such a shape and construction would be useful as a retention tunnel for a pod harness, but the preferred structure includes additional sewn seam connections 9, 10 along the remaining edges of elastic band 1 and stabilizing plate 4 that will ultimately serve as the open ends of the retention tunnel.

Figure 3:
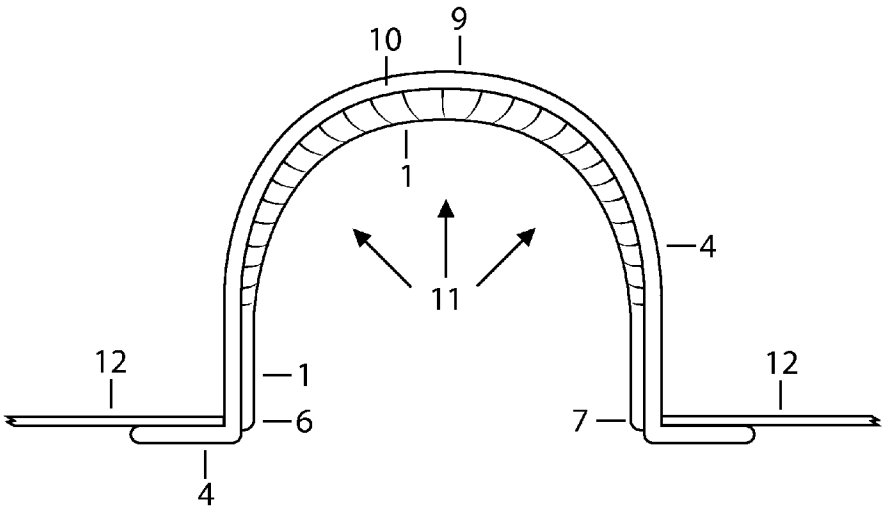
FIG. 3 depicts the formation of a paintball pod retention tube when the bent stabilizing plate and elastic band curved into a saddle-shaped, hyperbolic, paraboloid are secured to a back plate.
Figure 8:
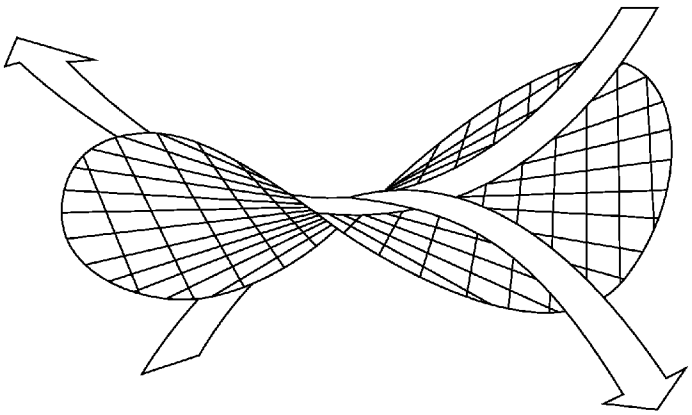
FIG. 8 is a conventional hyperbolic paraboloid and is similar to the shape assumed by the elastic band within the retention tunnel of the present invention.

FIG. 3 shows a retention tunnel 11 in which seam 10 is located in the front of tunnel 11 and seam 9 is at the rear. Elastic band 1 is secured to stabilizing plate 4 along all four edges of elastic band 1. Elastic band 1 is under some curvature stress due to the attachments within the longer stabilizing plate 4 and thereby forms a configuration akin to that of a saddle-shaped, hyperbolic paraboloid (see FIG. 8). The elastic band 1 is under tension between the stabilizing plate sides and thereby creates the paraboloid having an elastic diameter which is smaller than a paintball pod. So when a paintball pod gets pushed in to the "holding tunnel" the elastic band 1 gets pushed up and to the sides. This creates an applied pressure on the short ends to hold the pod securely within the tunnel.

Figure 4:
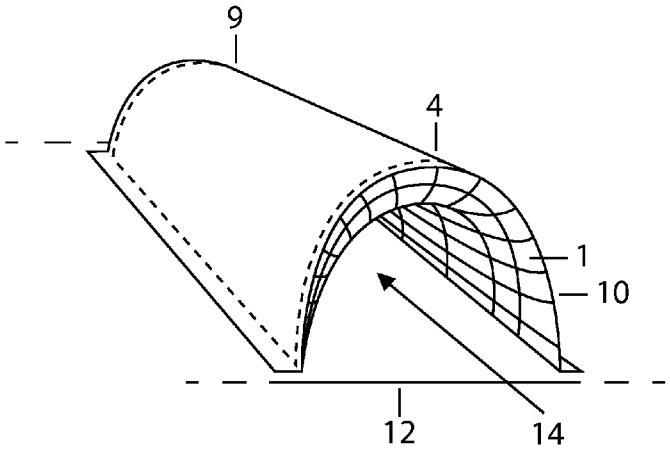
FIG. 4 presents an isometric view of a paintball retention tunnel and saddle-shaped elastic within the retention tunnel under the arc of the bent stabilizing plate.
Figure 5:
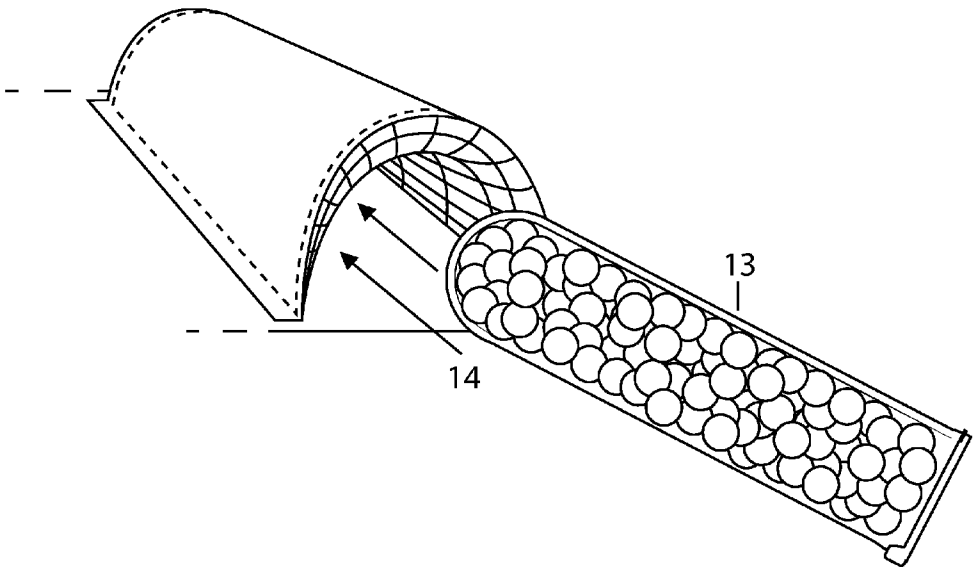
FIG. 5 illustrates how a filled paintball pod is inserted into the retention tunnel.
Figure 6:
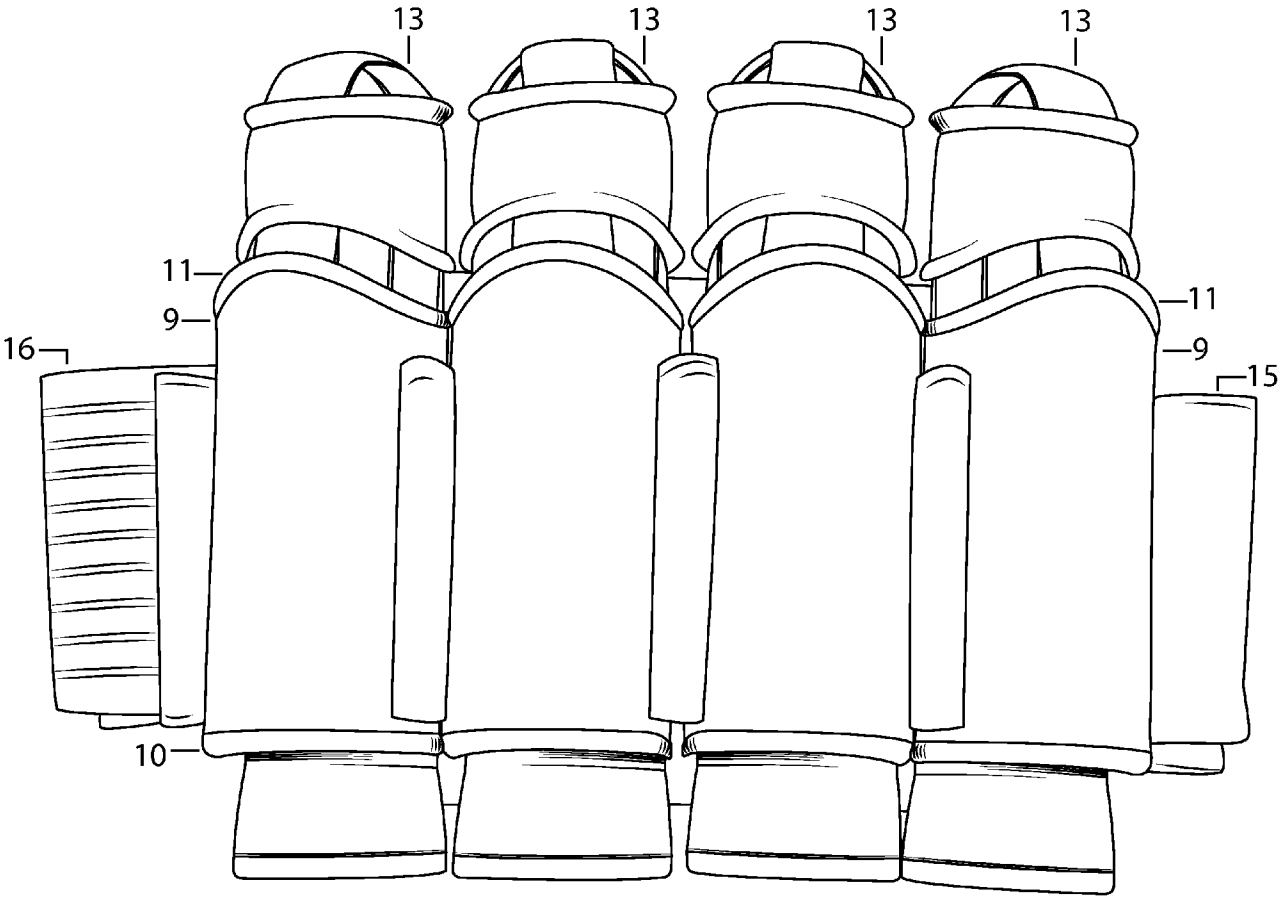
FIG. 6 depicts a carrying vertical pull paintball harness having four retention tunnels, three auxiliary elastic bands that can be used to carry additional pods, and a horizontal elastic waistband for the harness.

FIGS. 4 and 5 depict a retention tunnel according to the invention and the insertion of a filled paintball pod 13 into the forward tunnel opening 14. A plurality of such retention tunnels, e.g., 3-6 tunnels, can be secured to a back plate and form a harness of the type shown in FIG. 6.

Figure 7:
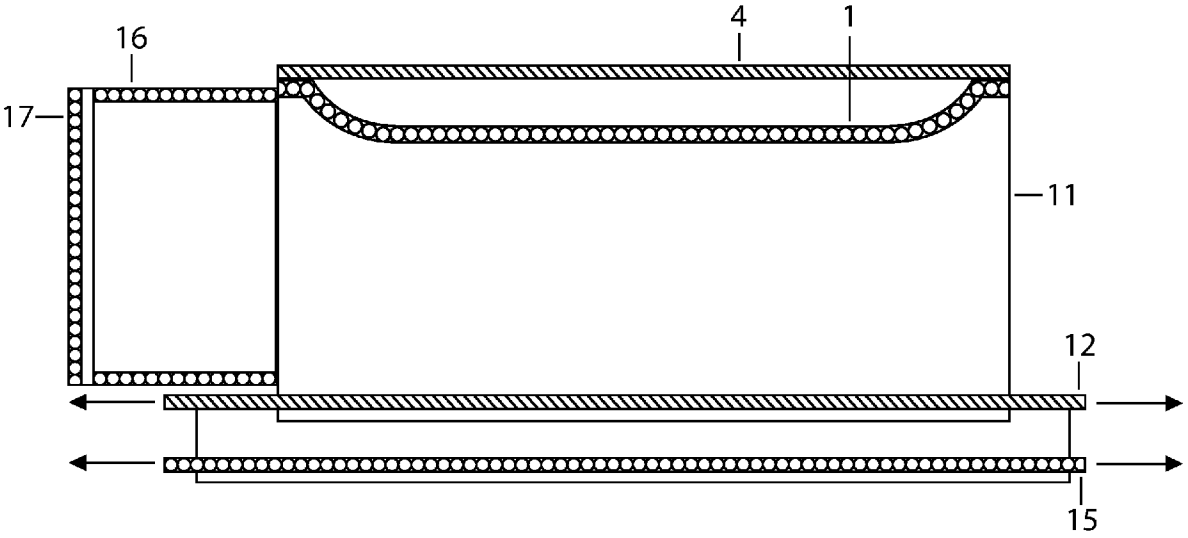
FIG. 7 is a cross sectional view of a retention tunnel showing the outer stabilizing plate and the curved, inner elastic band that provides the transverse retention force within the tunnel.

As sketched in FIGS. 3 and 7, retention tunnel 11 is secured to a back plate 12. Such back plates may be attached directly to one or more elastic straps 16 (see FIG. 6) that serve as an elastic waistband for the player or, as is more conventional, indirectly mounted on an inner elastic waistband 15 bearing hook-and-loop fasteners to secure the harness to the player. The elastic waistbands attached to the back plate can then be extended to overwrap the connection of the inner waistband 15 and form a second, outer, waistband that provides additional support for the harness when carrying a full complement of loaded pods 13.

FIG. 7 further illustrates a cross sectional view of a retention tunnel 11 with the stressed and curved elastic band 1 in position within retention tunnel 11 formed within the curvature of stabilizing plate 4. FIG. 7 further shows elastic end straps 16, 17 that can serve as a delimiting travel stop for pods 13 inserted into tunnel 11.

It is understood that the embodiments illustrated in the present invention are preferred and are not intended to serve as substantive limitations on the scope of the appended claims.

What is claimed is:

1. A holder for generally cylindrical or round objects that comprises at least one retention tunnel mounted on an elastic waistband, wherein said retention tunnel comprises: (a) an elastic band having four sides and stretchable in a stretch plane, (b) a semi-rigid stabilizing plate that is relatively wider than said elastic band in said stretch plane, wherein said stabilizing plate is attached to said elastic band on either side of said band transverse to said stretch axis whereby said tension from said elastic band causes said stabilizing plate to bend and form a retention tunnel exhibiting elastic, radial, compression forces on a generally cylindrical or round object when it is inserted into said tunnel.

2. A holder according to claim 1 wherein said base plate is also secured to said elastic band along at least one side of said plate that is substantially parallel to said stretch plane.

3. A holder according to claim 2 wherein said base plate is secured to said elastic band along top and bottom sides of said base plate that are each substantially parallel to said stretch plane.

4. A holder according to claim 3 wherein said elastic band forms a saddle-shaped, hyperbolic paraboloid plane within an arc of the bent stabilizing plate.

5. A holder according to claim 1 wherein the bent stabilizing plate and stretched elastic that is secured thereto are mounted on said waistband and form an elastically compressive retention tunnel.

6. A holder according to claim 5 wherein the bent stabilizing plate is secured to a back plate that is mounted on said waistband.

7. A holder according to claim 1 wherein said retention tunnel exhibits dimensions suitable to hold and retain a paintball pod.

8. A holder according to claim 1 wherein said retention tunnel exhibits dimensions suitable to hold and retain a water bottle.

9. A holder according to claim 1 wherein said retention tunnel exhibits dimensions suitable to hold and retain a sports ball.

10. A method for making a holder for a carrying harness, said method comprising:

(a) sewing an elastic band having a stretch plane to a first end of semi-rigid stabilizing plate having a length to a second end that is greater than said elastic band along the stretch axis, the sewing occurring on one side of the elastic band in a direction transverse to the stretch plane;

(b) stretching said elastic band along said stretch axis to the second end of said stabilizing plate;

(c) sewing the stretched end of said elastic band to the second end of the stabilizing plate in a direction transverse to said stretching plane, wherein tension from said elastic band would urge said stabilizing plate to bend and form an arc if not restrained;

(d) sewing said elastic band along at least one edge thereof to said stabilizing plate in a direction that is substantially parallel to said stretch plane, whereby elastic tension from said elastic waistband urges said stabilizer plate to bend, and said elastic band bends to form at least a portion of a saddle-shaped, hyperbolic paraboloid within an arc of the bent stabilizing plate thereby forming a paintball pod retention tunnel subject to the transverse holding effects of at least a portion of the saddle-shaped, hyperbolic paraboloid elastic band; and (e) securing the first and second ends of said stabilizing plate to a back plate that is attached to elastic waistband straps.

11. A method according to claim 10 wherein said elastic band is secured along a top edge thereof and a bottom edge thereof to said stabilizing plate by sewing.

12. A method of retaining one or more paintball pods in a carry pack according to claim 1, said method comprising: inserting a generally cylindrical paintball pod vertically upwardly through a bottom opening and into a the retention tunnel that is secured to the carry pack, said pack having two or more such retention tunnels and a waistband, whereby radially transverse frictional force from the interior of the retention tunnel wall retains said pod within said carry pack and wherein said carry pack does not have restraining straps that can cover the bottom openings of each retention tunnel.

13. A method according to claim 12 wherein at least one of said retention tunnels has an interior wall formed by an elastic member exhibiting at least a portion of the shape of a generally saddle-shaped, hyperbolic paraboloid that exerts retention force on an inserted pod.

* * * * *